US006082571A

United States Patent [19]

Avery

[11] Patent Number: 6,082,571

[45] Date of Patent: Jul. 4, 2000

[54] SHEATH-STRUCTURE CONTAINER AND METHOD FOR MANUFACTURING THEREOF

[75] Inventor: Donald J. Avery, Chesterfield, Mo.

[73] Assignee: D. J. Avery Group, Inc., Chesterfield, Mo.

[21] Appl. No.: 08/479,682

[22] Filed: Jun. 7, 1995

[51] Int. Cl.[7] ..... B65D 25/36; B65D 25/54; B65D 30/16

[52] U.S. Cl. ..... 220/9.1; 220/642; 229/162; 229/939

[58] Field of Search ..... 206/497, 320; 229/23 R, 23 A, 162, 939; 220/9.1, 642, 9.2, 9.3, 9.4

[56] References Cited

U.S. PATENT DOCUMENTS

| | | | |
|---|---|---|---|
| 1,609,030 | 11/1926 | Margolius | 220/9.1 |
| 2,017,222 | 10/1935 | Thomas | 220/9.1 |
| 2,123,723 | 7/1938 | Furrer | 220/9.1 |
| 2,700,460 | 1/1955 | Hoover . | |
| 2,735,607 | 2/1956 | Wasyluka | 229/23 A X |
| 2,938,656 | 5/1960 | Bertram | 229/939 |
| 2,941,710 | 6/1960 | Smith et al. | 220/9.1 X |
| 3,055,568 | 9/1962 | Zalkind . | |
| 3,357,626 | 12/1967 | Carpenter et al. . | |
| 3,613,985 | 10/1971 | Goodsite . | |
| 3,885,730 | 5/1975 | Christensson . | |
| 3,891,086 | 6/1975 | Isaacs | 206/497 X |
| 3,902,651 | 9/1975 | Marshall . | |
| 4,267,928 | 5/1981 | Curry, Jr. . | |
| 4,444,355 | 4/1984 | Cary . | |
| 4,466,553 | 8/1984 | Zenger . | |
| 4,558,801 | 12/1985 | Vilutis . | |
| 4,585,159 | 4/1986 | Travis | 220/9.2 X |
| 4,624,380 | 11/1986 | Wernette | 220/642 X |
| 4,679,724 | 7/1987 | Inagaki . | |
| 4,811,840 | 3/1989 | Muyskens | 206/497 X |
| 4,919,270 | 4/1990 | Govang et al. | 206/497 X |
| 5,215,248 | 6/1993 | Moser | 229/23 A X |
| 5,271,498 | 12/1993 | Gillespie | 206/497 X |
| 5,277,310 | 1/1994 | Mertz | 206/320 |
| 5,289,969 | 3/1994 | Schwaner | 206/320 X |
| 5,307,928 | 5/1994 | Bishop | 206/586 X |
| 5,573,176 | 11/1996 | Applegate | 229/162 |

*Primary Examiner*—Stephen Castellano
*Assistant Examiner*—Niki M. Eloshway
*Attorney, Agent, or Firm*—Peter S. Gilster

[57] ABSTRACT

A container for commercial packaging of goods protects against stresses of filling, storage, distribution, merchandising and use of the container. It includes a structural framework and a sheath conforming to at least portions of the framework, which has horizontal and vertical members which define lengthwise and upright structural elements forming panels joined at corners provided by the upright elements. There may be as few as least one lengthwise structural element of each panel with at least one vertical element at each corner. The panels are thus provided with windows therein to provide an essentially skeletonized structure. The structural elements are of recyclable and/or reuseable structural material and configuration as will provide the container with a strength which is at least about 80–85% of the strength of a non-windowed container of such structural material. The sheath has barrier properties to enclose the goods therein in protected relationship.

Various methods of making the container structures are disclosed, including providing a first series of first type framework structural members, each defining a horizontal structural member for the container; and a second series of second type framework structural members, each defining a vertical structural member for the container. The horizontal and vertical members are joined in mutually perpendicular relation define respective rectangular panels and with the panels being joined in side-by-side relation as an array of panels corresponding to intended container walls which array is folded into a closed configuration to complete the framework. The sheath is then applied to the completed framework.

10 Claims, 6 Drawing Sheets

SHEATH-STRUCTURE CONTAINER AND METHOD FOR MANUFACTURING THEREOF

BACKGROUND OF THE INVENTION

This invention relates to improvements in primary, secondary and display containers for food, beverages and other consumer products packaged in a sealed condition to prolong the useable life of the product and to protect the product against air, other gases, and/or moisture as well as to provide physical protection during filling, processing, warehousing, distribution, merchandising and customer use.

Packaging is a multibillion dollar industry. In the food, beverage and consumer goods portion of the packaging industry, the costs associated with conventional containers, whether made of metal, plastic, glass, paperboard, composite, or of single-layer or multilayer materials, are a continually pressing concern because of materials' costs and disposability concerns. These costs are directly reduced, however, by decreasing the amount of material used resulting in a concomitant reduction in the amount of material requiring disposal and, consequently, the costs associated therewith. Disposal costs are further reduced when the material used is recyclable and/or reuseable in nature.

Thus there have been long-standing, unresolved problems of providing cost-effective packaging suitable for use as a primary, secondary or display container that uses less material yet provides a recyclable container capable of surviving the rigors and stresses of processing, filling, warehousing, distribution, merchandising and customer use.

As compared with other materials of which containers may be formed, paper, such as in the form of layers of wound paperboard or cardboard is the most widely used and the least expensive. This remains true in spite of recent sharp increases in the price of paper. Since paper is a semisynthetic product made by chemically processing cellulosic fibers, such as from various sources including mainly soft woods but also sometimes hard woods as well as other raw organic materials, including flax, bagasse, straw, etc., it is the ultimately preferred material from an environmental viewpoint. It permits recycling of organic source materials, including waste products, and is both incinerable as well as biodegradable. Moreover, paper materials, on a pound-per-pound basis, are also among the strongest available container materials, providing extremely high tensile strength coupled with resilience, as desirable for container manufacturing and intended uses.

It is believed that the packaging industry has failed to address the needs and concerns to which the present invention is directed; the packaging industry has developed around standardized production, concentrating on existing technology and endeavoring to protect existing markets. Consequently, what is needed is a new generation of low-cost recyclable and/or reuseable containers capable of providing the full host of functions consumers demand or expect from containers, including the ability to be handled, shipped, S stored and stacked as well as go directly from shipping or storage into merchandising and display without compromising function undersirably and yet achieving a new economy of material content and cost.

SUMMARY OF THE INVENTION

This invention satisfies the above needs. This invention is a novel low-cost recyclable and/or reuseable container including a structural framework capable of serving as a primary, secondary or display container and having the capacity to survive the rigors and stresses of processing, filling, warehousing, distribution, merchandising and customer use and method of producing the same.

The present invention constitutes an improvement of the inventive subject matter set forth in U.S. Pat. No. 4,982,872 of the present inventor, entitled Film-Encapsulated-Structure Container for Food, Beverages and Other Consumable Products and Method for Making of Same, which is herein incorporated by reference.

Among the various advantages of the present invention are to provide a primary, secondary and display container for the containment of food, beverages, and other consumable products which may require packaging in a sealed condition. It is thus an advantage of the invention to provide a container which, although being contents protecting and including the capability of protecting the container and its product against the stresses of processing, filling, warehousing, distribution, merchandising and customer use, is capable of providing the barrier protection for the products against permeation through the container of water vapor or gases of greater than desirable and maximum permissible permeation rates.

It is further an advantage of the invention to provide such a container providing an economy of materials cost and manufacturing cost which has never here before been obtained in such containers, particularly those utilized for food, beverage and other consumable products packaging.

It is also an advantage of the present invention to provide such a container which makes possible the utilization of virgin or non-virgin or recycled low cost materials which have not before been utilized effectively and economically in food, beverage and consumable product containers such as, for example, paperboard, plastic, and recycled material of various types, including recycled metals, glass and polymers such as PE, PP, PET, SELAR, PETG, PVC and nylon, etc. and composites of such materials.

Among still other advantages of the invention may be noted the provision of such a container which is of extremely lightweight character, utilizing an absolute minimum amount of materials, yet capable of demonstrating strength adequate for the protection of the product and container through such stresses and rigors as indicated above; which container can utilize thermoplastics and other materials which offer materials cost and processing economies; and which lends itself to the use of structural elements which are formed with perforated or other area-relieved construction in order to eliminate the presence of material where it is not required for a structural purpose, thus eliminating the material cost for such eliminated material, while making also possible an extremely light weight construction.

Another advantage of the invention is that it eliminates up to about 70% or more of, for example, the corrugated paperboard material in a regular slotted corrugated paperboard container while maintaining up to about 85% or more of the compression strength of such container when the corrugation runs in elongate sense of any member. An additional advantage of the invention is that the material eliminated may be replaced by a sheath of, for example, poly film which is generally up to 30% less costly than, for example, paper-based materials.

A further advantage of the invention is to provide a container in which the traditional container functions of contents-barrier protection and container stresses protection may be functionally separated between structure and vessel components of the container without compromise of strength or protective capabilities. It is a related advantage of the invention to provide such a container which uses materials for providing structural characteristics which are the most inexpensive materials available, wherein the bulk of such structural material provides protection against the stresses which the container must encounter in normal use, while utilizing for the vessel a material which is of thickness requisite only for providing protection against the intrusion of contaminants and undesirable permeation of water vapor and gases such as carbon dioxide and oxygen. That is to say, the container is intended to provide for the prevention of oxygen and oxygen permeation into the container, which might spoil a product which oxidizes or otherwise spoils in the presence of oxygen, as well to retain in the container gases intrinsic in a product which might diffuse or otherwise permeate through the walls of the container. It is a related advantage of the invention to provide such a container wherein barrier materials are not utilized for structural aspects of the invention, but can be instead limited to the vessel component which can thereby be formed with thinness not heretofore desirable or practical, as for example, for container intended for food, beverages and other consumable products. Such a container has the further advantage in that because the functions of barrier protection and functional strength are separated stresses in the functional aspect of the container do not compromise the product protection provided by the vessel component. That is, stresses on the structural component do not adversely affect the vessel component, and vice versa.

Another advantage of the invention is the provision of such a container which utilizes materials which are more "environmentally friendly" such as, for example, in being more readily and easily biodegradable than existing synthetic containers, and which alternatively makes possible the use of materials which can be recycled and/or reused again and again in order to minimize the amount of waste in landfills, or as a further advantage readily permitting incineration without risk or the introduction of contaminants into the atmosphere. Such a container provides the further advantage of permitting a structural component of non-virgin material which can be easily separated (as for permitting recycling or reuse) from the vessel component which may be, for example, of virgin material which easily can be incinerated, recycled or reused.

It is an advantage of the invention to provide a container in which either both the vessel component and structural components may be of either virgin or non-virgin material, and wherein the specific nature of the one of the components, such as the material of the vessel component, does not dictate the material to be used for the other component or its characteristics.

It is also an advantage of the invention that the material of the structural components may be of, for example, metals, paperboard, plastics, and recycled materials of various types, including recycled paper, metals, glass and polymers. An additional advantage of the invention is that the structural components may be of various shapes, including L-, V-, rectangular-, circular-, elliptical-, cylindrical-, square-, star-, triangular-, and/or octagonal-shaped as well as irregular and other polygonal cross-sections and shapes. Moreover, the structural components may be adhered, snapped, inserted one into the other, bonded, hinged, fastened, strapped, stapled, hung, and/or bracketed or otherwise secured together.

It should also be noted that an advantage of the invention is the provision of such a container which allows economical, highly functional closures which can be readily opened but do not compromise the security of the package and are tamper-resistant and tamper-evident.

Another advantage of the invention is to provide a container which can be used as a secondary container, such as for providing a shipper function, as for storage and transport.

An additional advantage of the invention is to provide a container which can also perform as a display container and placed directly on display thus minimizing the amount of handling of the container's contents and consequently reducing labor costs.

Another advantage of the invention is that a plurality of the structural members on the bottom of the container may easily be flanged or lipped to allow the insertion of a floor.

A further advantage of the invention is the provision of such a container which utilizes materials which allow graphics, trademarks, logos, universal price and product codes and various other matter to be printed easily, reliably and effectively on encapsulating film or structural components of the container.

An additional advantage of the invention is that if, for example, the structural pieces are die-cut, they can be configured such that waste is minimized from the die-cut process.

It is further an advantage of the invention to provide a method of producing a container of the invention, which method is economical, easily carried out by utilization of existing technologies or ready modifications thereof, which provides marked economy and through-put, and which can be carried out without the highest degree of automation.

Further features and advantages of the present invention, as well as the structure and operation of various embodiments of the present invention, are described in detail below with reference to the accompanying drawings.

Briefly, the invention provides a container for commercial packaging of goods. The container protects against the stresses of filling, storage, distribution, merchandising and use of the container. The container comprises, in combination, a structural framework and a sheath for conforming to portions of the framework. The framework provides a contents-receptive configuration of the container and protects the container and its contents against the stresses noted hereinabove. The framework is constituted by a plurality of horizontal and vertical members. The horizontal members define lengthwise structural elements and the vertical members define upright structural elements. These members are configured such there are a plurality of panels of the framework joined at corners defined by the upright structural elements. At each corner there is at least one lengthwise structural element of each panel and at least one vertical element. The structural elements define, for at least a plurality of such panels, respective windows therein to provide an essentially skeletonized structure. It may be, if effect, an exoskeleton. The structural elements are of such structural material and configuration as will provide the container with a strength which is at least about 80–85% or more of the strength of a non-windowed container of such structural material. The structural material may be of recyclable and/or reuseable character thus permitting recycling thereof for subsequent reincorporation in subsequent generations of containers. The sheath may have preselected barrier properties and extend over portions of the container so as to enclose the goods therein in a protected relationship.

Further features and advantages of the present invention, as well as the structure and operation of various embodiments of the present invention, are described in detail below with reference to the accompanying drawings.

A further advantage of the invention is that it provides a method of making a container for commercial use. The method comprises forming a structural framework for the container by providing a first series of first type framework structural members. Each first type framework structural member defines a horizontal structural member for the container. The method further provides a second series of second type framework structural members. Each second type framework structural member defines a vertical structural member for the container. The respective first type framework structural members are joined in perpendicular relation to the second type framework structural members and located or positioned at respective ends of the first and second type framework structural members. When joined in such a manner the first and second typed framework structural members define respective rectangular panels. Each rectangular panel is bounded along one edge by at least a first type framework structural member and bounded along adjacent edges at opposite ends of the first type framework structural member by second type framework structural members. When so bounded, the panels are joined together in side-by-side relation as an array of panels with at least one second type framework structural member at each end of the panels. The panels correspond to intended walls of the container. An array of such panels are folded together into a closed configuration to complete the structural framework with each of the panels defining a wall of the container. A sheath may be applied to the completed structural framework. The sheath may conform thereto such that it extends across the panels for containment within the sheath of a product to be packaged by the container.

DETAILED DESCRIPTION OF THE PREFERRED EMBODIMENTS

Figure 1:
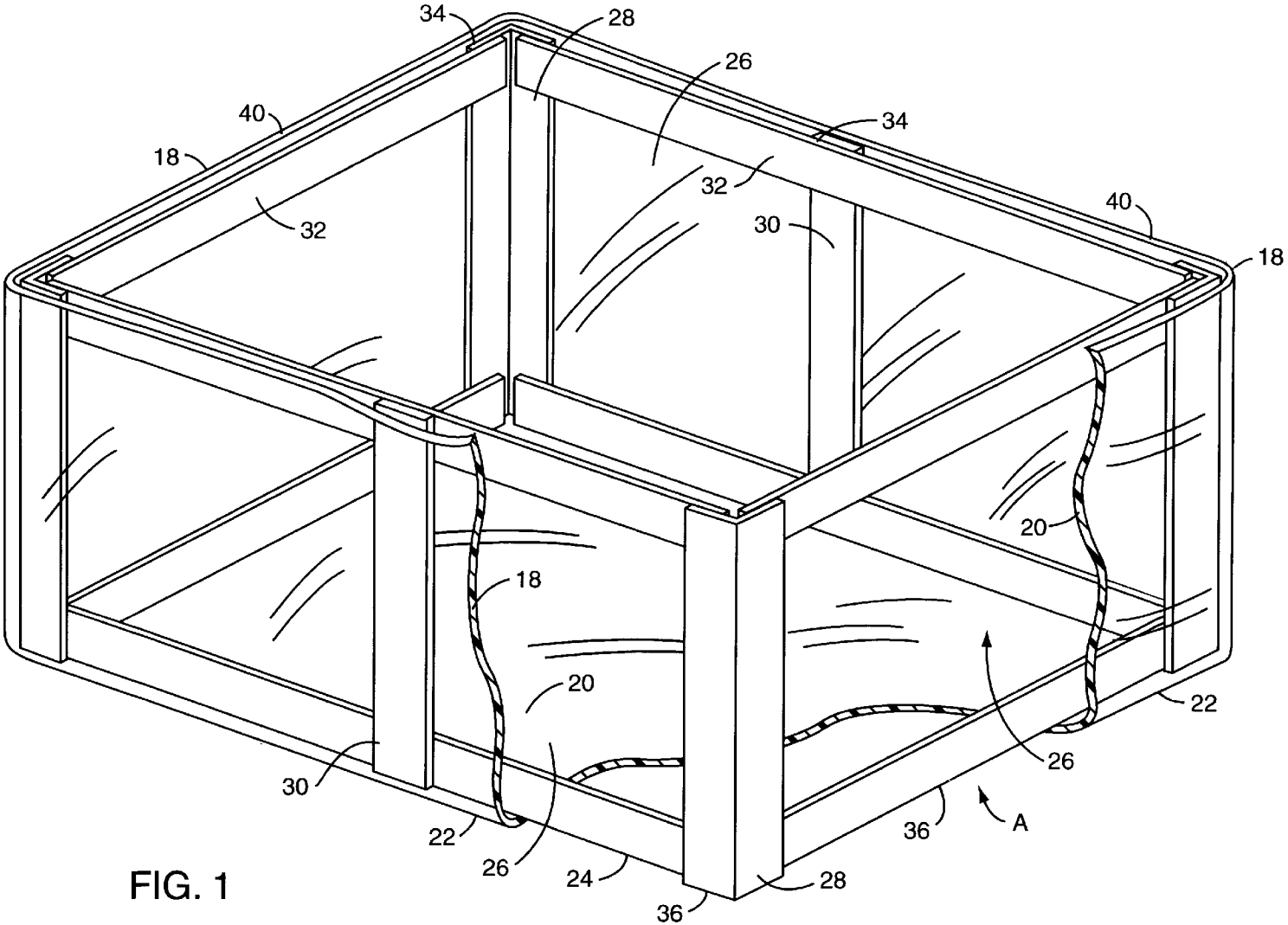
FIG. 1 is a perspective view of a container of a first embodiment in accordance with the invention.

FIG. 1 demonstrates a container A for consumer products and like contents. A sheath 18 made of film having inner and outer surfaces 20 and 22 is used to cover portions of a skeletonized framework structure 24 formed of paperboard or other virgin or non-virgin polymers, paper materials or metals. In the event the contents to be contained in such framework structure do not otherwise require, framework structure 24 may be of non-virgin recycled metals, paper, PP, PE, PET, PVC or PETG. Large rectangular relieved areas 26 are shown, providing thus a windowed configuration, by leaving corner pieces 28, pillars 30 and cross-pieces 32. Other relieved area shaping is possible, consistent with such windowed, skeletonized concepts. Other shaping of the corner pieces 28, pillars 30 and cross-pieces 32 is possible. A rim 34 extends around the upper periphery of framework structure 24 and similarly a bottom edge or rim 36 is provided extending around the lower periphery of framework structure 24. Accordingly, cross-pieces 32 serve as horizontal structural members, and corner pieces 28 and pillars 30 serve as vertical structural members, together constituting the skeletonized structural framework 24.

Sheath 18 may be drawn from a cast, blown, extruded, laminated or rolled length of film material and is applied by forming the inner surface 20 of sheath 18 on the exterior surfaces of framework structure 24 and then bonding (as explained below) inner portion 20 as needed to predetermined locations on the exterior surfaces of framework 24. The upper edge 40 of sheath 18 may also be folded over rim 34 and bonded as needed at predetermined locations on the interior surfaces of framework structure 24 (not shown). Obversely, the sheath nay be applied internally thereof.

Framework structure 24 may be formed of various possible materials, such as most preferably corrugated cardboard, or corrugated polymeric material; but paperboard, as by wound spirally or convolutely, or die-cut and formed, may be instead used and it may be single-ply or multi-ply. These are very inexpensive materials as they are made from paper, i.e., a semisynthetic product made by chemical processing of cellulosic fibers from various possible sources including soft woods but also sometimes hard woods as well as other raw organic materials, including flax, bagasse, straw, and so forth. Such paper-based material offers an environmental advantage, as it may be recycled and re-used due to its organic nature, provides unobjectionable waste products, and is both incinerable as well as biodegradable.

Framework structure 24 may also be advantageously formed of virgin or scrap or recycled polymeric material such as PE, PP and PET, and may in general be a single polymer or mixed or commingled polymers, or several layers of polymers. Framework structure 24 may particularly be of material or materials which can be recycled time and time again in the packaging industry.

Sheath 18 may be formed from various possible materials, heretofore identified, including polymeric extruded, coextruded, cast, blown or laminated sheet and film material such as polyolefins, polyesters, nylons, and coated cellophanes. Some of the high barrier films which can be used in conjunction with these groups are commercially available under the designations "EVAL" (or "EVOH"), the sarans and certain resins available under the trade designation SELAR. Olefinic polymers which can be used, for example, are high density polyethylene (HDPE), ultra high molecular weight polyethylene (UHMWPE), polypropylene (PP) and oriented polypropylene (OPP), polystyrene (PS), high-impact polystyrene (HIPS), various copolymers and terpolymers such as acrylonitrile butadiene-styrene (ABS), high nitrile barrier resins including styrene acrylonitrile (SAN), "BAREX" polymer and polyethylene terephthalate (PET and PETG). Moreover, there have been a combination of materials with mono-layers and other low barrier materials, such as low and high density polyethylene (LDPE, HDPE). As other barrier materials, there may specifically be used PET film (MYLAR) and polyvinylidene chloride (PVDC). Other possible sheath materials having barrier properties include foil, foil/polymer combinations, and metallized polymer films. Paper materials, treated and coated with suitable barrier-forming polymeric materials may also be used, including paper suitably laminated with such barrier materials. The barrier characteristics may be those set forth in above-referenced U.S. Pat. No. 4,982,872

In any event the film material, which may be monolayered or multilayered, one material or multimaterial, to be utilized for sheath 18, must have its barrier or nonbarrier properties selected in accordance with the product to be contained. Such films may be cast, blown, extruded, laminated or otherwise drawn and provided in accordance with known technique.

It is not necessary that the film be restricted to a single or multiple layers of the same material. Instead, it may be a laminate having different material layers, such as aluminum foil carrying polymeric layers on one or opposite sides including tie layers or adhesive between the same, whereby only one layer may be in the strictest sense effective as a barrier layer.

It is also within the scope of the invention to vary the constitution as well as the thickness of sheath 18 as by stretching or by coextrusion technique suited for this purpose, whereby the thickness and/or constitution of sheath 18 will be different.

Regardless of the various film materials which may be utilized for the formulation of the sheath, the latter may be bonded to the framework structure 24 so that the structure is nowhere exposed to the food or other product to be packaged in the container, and/or so that the product is not exposed to an outside environment in which there may be contaminants, dirt, gases or high moisture. So also, the structure may be protected against outside contamination, and notable adverse influences such as water and water vapor in high moisture environments.

Figure 2:
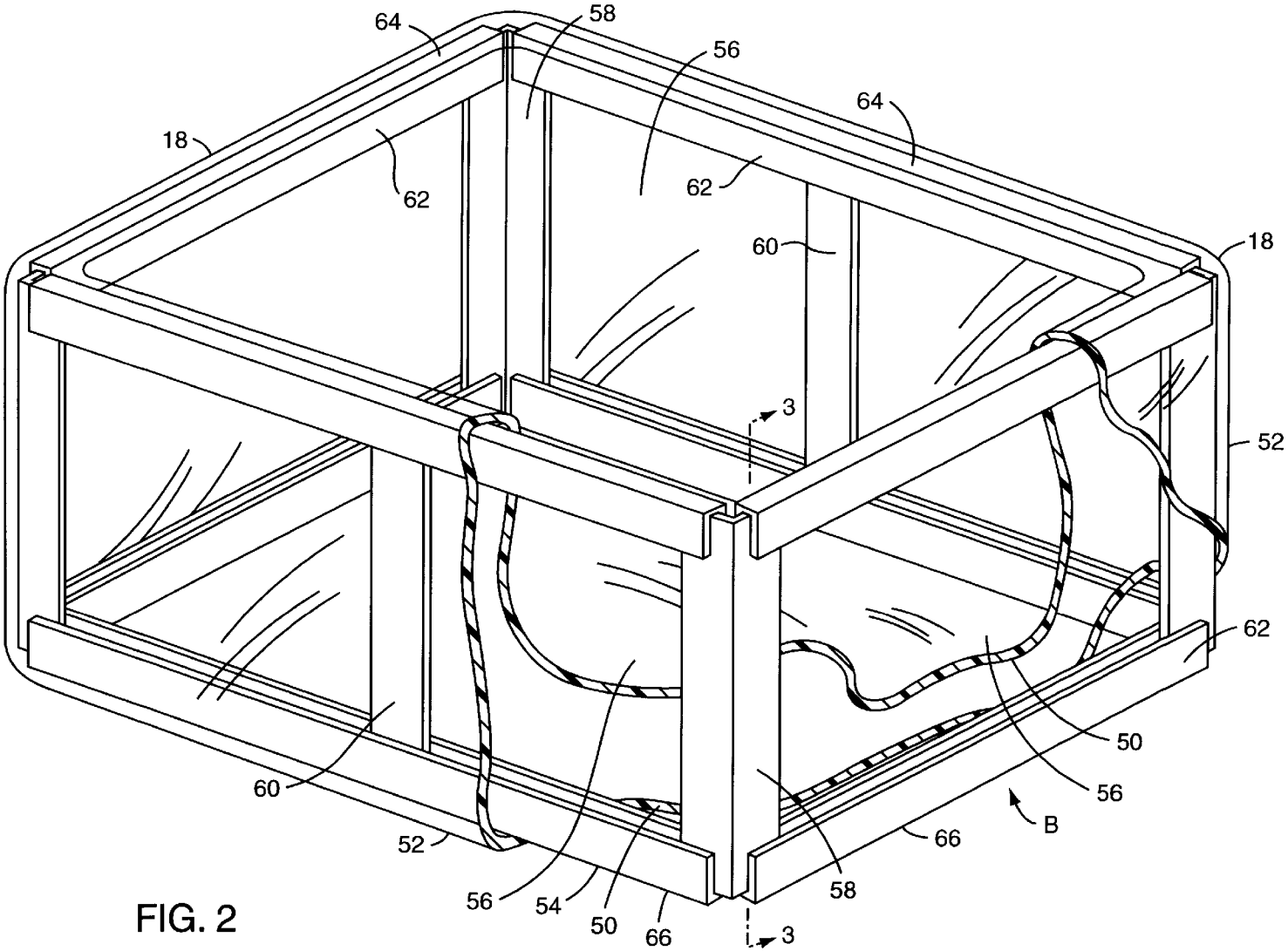
FIG. 2 is a perspective view of a container of a second embodiment of the invention.

Referring to FIG. 2, a container of embodiment B is illustrated. In FIG. 2, sheath 18 is formed of film material as in FIG. 1 having inner and outer surfaces 50 and 52 and used to encapsulate a skeletonized framework structure 54 formed of corrugated polymeric material or corrugated cardboard or paperboard or virgin or non-virgin metals, polymers or paper material, as indicated above, which may be required to be isolated from the product. The inner surface or portion 50, provides in effect a suspended pouch or bag within the structure, so that the contents can be kept suspended above and out of contact from the floor. If desired, a separate floor of cardboard or additional sheath material may be provided for further protection. Large rectangular relieved areas 56 are shown, leaving corner pieces 58, pillars 60 and U-shaped cross-pieces 62. Other relieved area shaping is possible. Other shaping of the corner pieces 58, pillars 60 and U-shaped cross-pieces 62 is possible. A rim 64 extends around the upper periphery of framework structure 54 and similarly a bottom edge or rim 66 is provided extending around the lower periphery of framework structure 54.

Sheath 18 may be drawn from methods similar to those referred to above for FIG. 1.

Framework structure 54 may thus be formed of various possible materials similar to those referred to above for framework structure 24 of FIG. 1.

Figure 3:
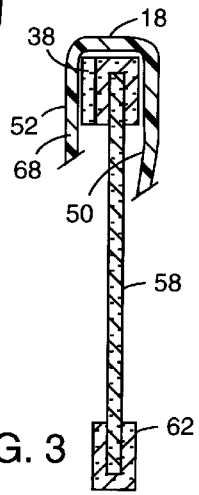
FIG. 3 is an enlarged fragmentary vertical cross section taken along line 3—3 of FIG. 2.

FIG. 3 provides a cross-sectional view of framework structure 54 and sheath 18 along line 3—3 of FIG. 2. The upper and lower ends of corner piece 58 rest in the U-shaped channel of cross-piece 62. The inner surface 50 of sheath 18 may be bonded by suitable bonding means to the interior surface of framework structure 54. A bond 68, as provided by heat sealing or a suitable type of adhesive compatible with the material of which sheath is formed, may be provided for causing a sealed relationship between the inner surface 50 of sheath 18 and the interior surface of framework structure 54. A band 38 of adhesive is provided between the inner surface 50 of sheath 18 and the exterior surface of framework structure 54, but such adhesive may instead be in the form of multiple bands, stripes, dots or otherwise formed, and extends over only small portions of structural framework 54 or over major portions thereof, being used to secure sheath 18 at predetermined locations on framework structure 54 for maintaining a precise inter relationship between them.

Figure 4:
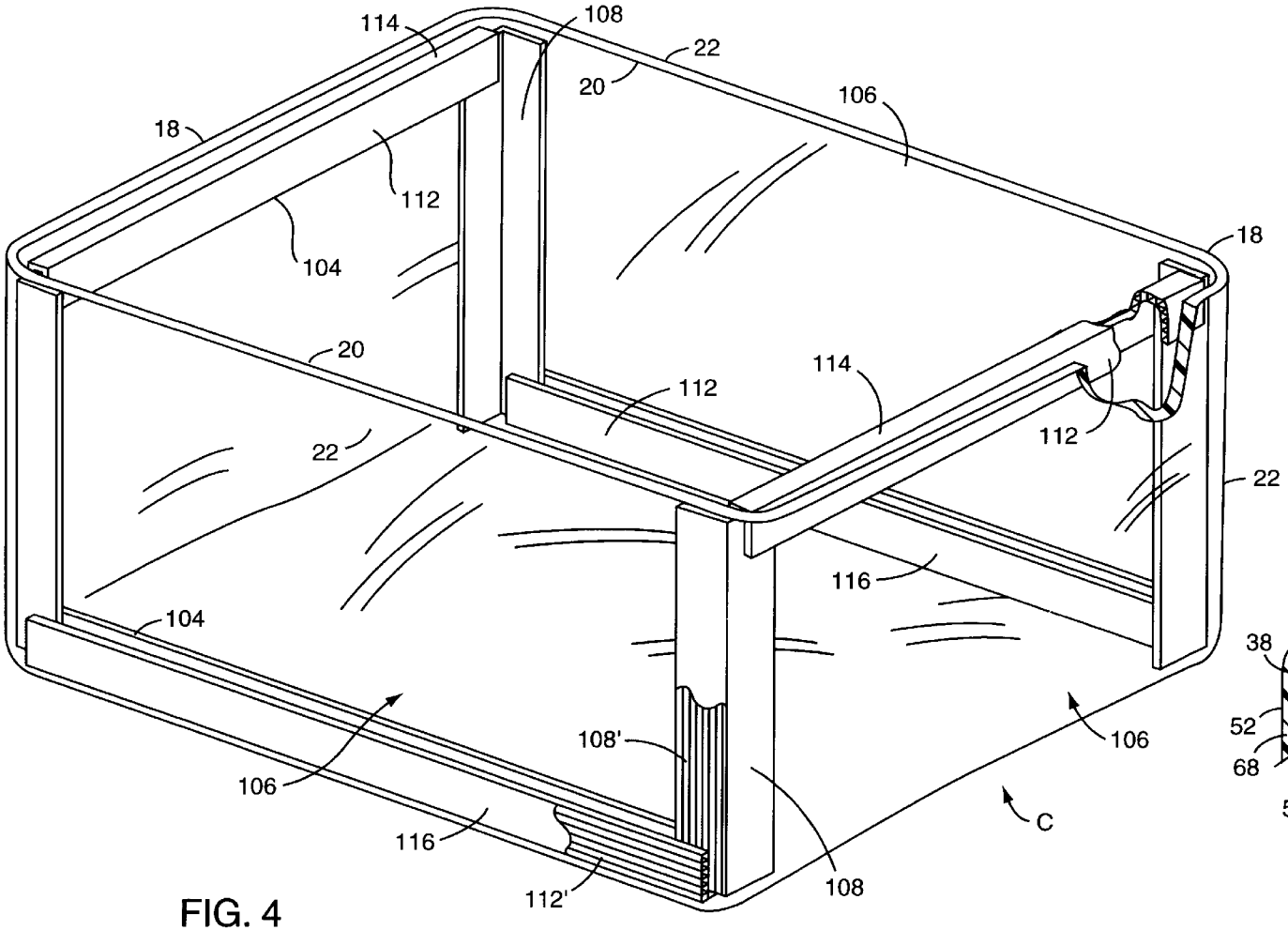
FIG. 4 is a perspective view of a container according to a third embodiment of the invention.

FIG. 4 shows embodiment C of the container. In FIG. 4, sheath 18 is formed of film material as in FIG. 1 having inner and outer surfaces 20 and 22 and used to cover portions of framework structure 104 formed materials as hereinabove identified, which may or may not be required to be isolated from the product. Large rectangular relieved areas 106 are shown, leaving corner pieces 108 and U-shaped cross-pieces 112. Other relieved area shaping is possible. Other shaping of the corner pieces 108 and U-shaped cross-pieces 112 is possible. A rim 114 extends in a noncontinuous manner around the upper periphery of framework structure 104 and similarly a bottom edge or rim 116 is provided extending in a noncontinuous manner around the lower periphery of framework structure 104.

FIG. 4 also shows the preferred elongation of the corrugation in structural framework 104. For cross-pieces, the preferred elongation of the corrugation is noted at cross-piece 112'. For pillars and corner pieces, the preferred orientation of the corrugation is noted at corner piece 108'. Thus, the direction of the corrugations is the same as the direction of elongation of each respective structural framework member.

Sheath 18 may be drawn from methods similar to those referred to above for FIG. 1.

Framework structure 104 may be formed of various possible materials similar to those referred to above for framework structure 24 of FIG. 1.

Accordingly, it is apparent from FIG. 4 that when framework structure 104 is viewed from the side having cross-piece 112' on the lower periphery of framework structure 104, framework structure 104 resembles the upper-case letter "U". Moreover, when framework structure 104 is viewed from the side having cross-piece 112 on the upper periphery of framework structure 104, framework structure 104 resembles the lower-case letter "n". It is also apparent from FIG. 4 that framework structure 104 may be turned upside down such that cross-piece 112' is on the upper periphery of framework structure 104. Thus when framework structure 104 is viewed from the side having cross-piece 112' on the upper periphery of framework structure 104, framework structure 104 resembles the lower-case letter "n". Also, when framework structure 104 is viewed from the side having cross-piece 112 on the lower periphery of framework structure 104, framework structure 104 resembles the upper-case letter "U". Whether cross-piece 112' is on the upper or lower periphery of framework structure 104, the sheath covers portions of the framework structure such that the container remain contents receptive along its upper periphery.

Figure 5:
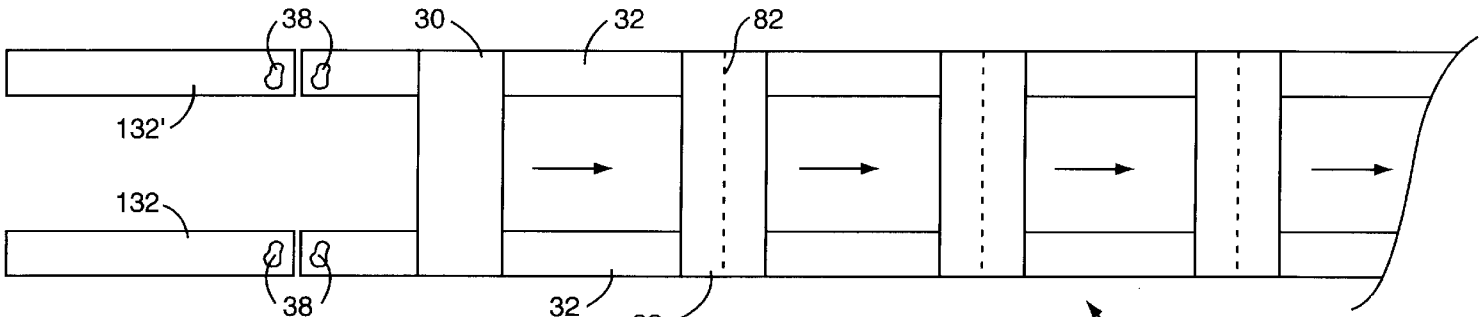
FIG. 5 is a top plan view of a first method embodiment of making a container as disclosed herein.

Therefore, it is seen that a simplified, skeletonized container for commercial packaging of goods with protection of such goods against the stresses of filling, storage, distribution, merchandising and use of the container, comprises the following:

a structural framework providing a polygonal contents-receptive configuration of the container and protecting the container and its contents against such stresses, the framework constituted of framework elements comprising at least four pillars interconnected by bridging cross-pieces, to provide an essentially skeletonized structure, with at least some of said pillars defining respective corners of the framework, each pair of pillars being connected by only one bridging cross-piece to define geometrically window-defining side-wall panels of the framework, which thereby is of multiple-sided character, the pillars being joined in successive pairs alternatively by upper and lower bridging-members with the upper bridging cross-pieces defining an upper periphery of the container and the lower bridging cross-pieces defining a lower periphery of the container, such that as viewed from one side of the container or from a side opposite therefrom, the framework elements of each panel alternately generally resemble the letter "n" or the letter "U" as viewed from adjacent the panel, the framework elements being each of structural material and configuration as will provide the container with a strength sufficient to withstand the stresses of filling, storage, distribution, merchandising and use of the container, the structural material being either recyclable or reusable or both recyclable and reusable to permit subsequent reincorporation by recycling in subsequent generations of containers, the framework adapted for receiving a sheath for conforming to the framework at least over portions thereof, which sheath has selected barrier properties and extending over portions of said container so as to enclose the goods therein in protected FIG. 5 depicts a continuous method U for making a structure for a container such as that of embodiment A. Supplies 132 and 132' of rolled sheet materials provide cross-pieces 32 of predetermined dimensions. Adhesive 38 is supplied to the cross-pieces 32 at predetermined locations thereon. Pillars 30 of predetermined dimensions are placed overlaying cross-pieces 32 where adhesive 38 has been placed. Pillars 30 may be scored or perforated 82 and thus will become corner pieces 28 for the framework structure.

Figure 6:
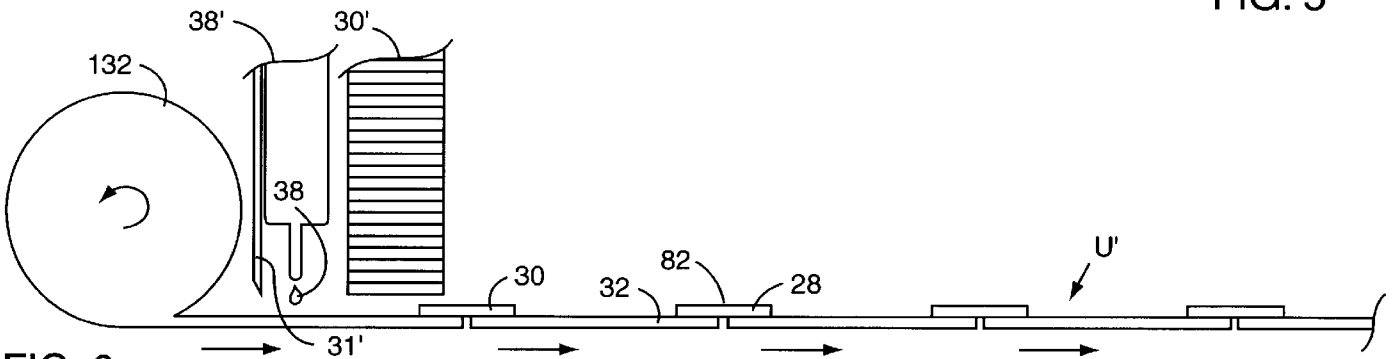
FIG. 6 is a side elevation view of the first method embodiment.

Accordingly such methodology effectively joins respective the first type framework structural members, namely the cross-pieces, in perpendicular relation to second type framework structural members, namely the corners, as well as optionally pillars, at respective ends of the first and second type framework structural members, to define respective rectangular panels each bounded along one edge by at least a first type framework structural member and bounded along adjacent edges at opposite ends of the first type framework structural member by second type framework structural members, whereby the panels are joined together in side-by-side relation as an array of panels with at least one second type framework structural member at each end of the panels, the panels corresponding to intended walls of the container;

FIG. 6 shows a continuous method embodiment U' for making a container structure of the invention. Supplies 132 and 132' (132' not shown) of rolled sheet material provide cross-pieces 32. A cutting implement 31' such as a shear is used to cut the rolled sheet material into cross-pieces 32 of predetermined dimensions. Adhesive 38 from adhesive reservoir 38' is supplied to the cross-pieces 32 at predetermined locations thereon. A supply of pillars 30' places a pillar 30 of predetermined dimensions overlaying cross-pieces 32 where adhesive 38 has been placed. Pillars 30 may be scored or perforated 82 and thus will become corner pieces 28 for the framework structure.

Figure 7:
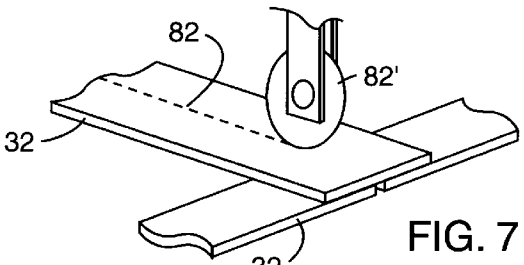
FIG. 7 is an enlarged view showing steps to score or perforate the paperboard or cardboard corner members and optionally used in the several method embodiments.

FIG. 7 depicts a procedure optionally used to score or perforate cross-pieces at predetermined locations. A scoring or perforating implement 82' moves lengthwise across cross-piece 32 at a predetermined location scoring or perforating 82 same. Cross-pieces so scored or perforated will become corner pieces 28 for the framework structure by bending along the resultant line of weakness.

Figure 8:
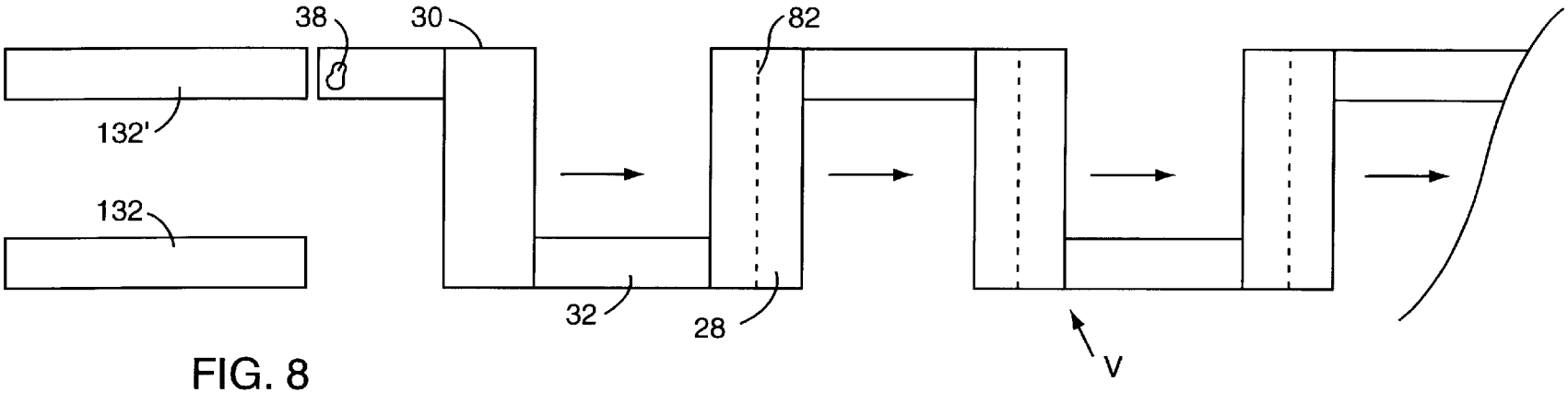
FIG. 8 is a top plan view of a second method embodiment according to the invention.

FIG. 8 shows a continuous method V for making another embodiment of a structure for the present container. Supplies 132 and 132' of rolled sheet materials provide, perhaps alternatingly, cross-pieces 32 of predetermined dimensions. Adhesive 38 is supplied to the cross-pieces 32 at predetermined locations thereon. Pillars 30 of predetermined dimensions are placed overlaying cross-pieces 32 where adhesive 38 has been placed. Pillars 30 may be scored or perforated 82 and thus will become corner pieces 28 for the framework structure. The resultant structure array is of a zig-zag character.

Figure 9:
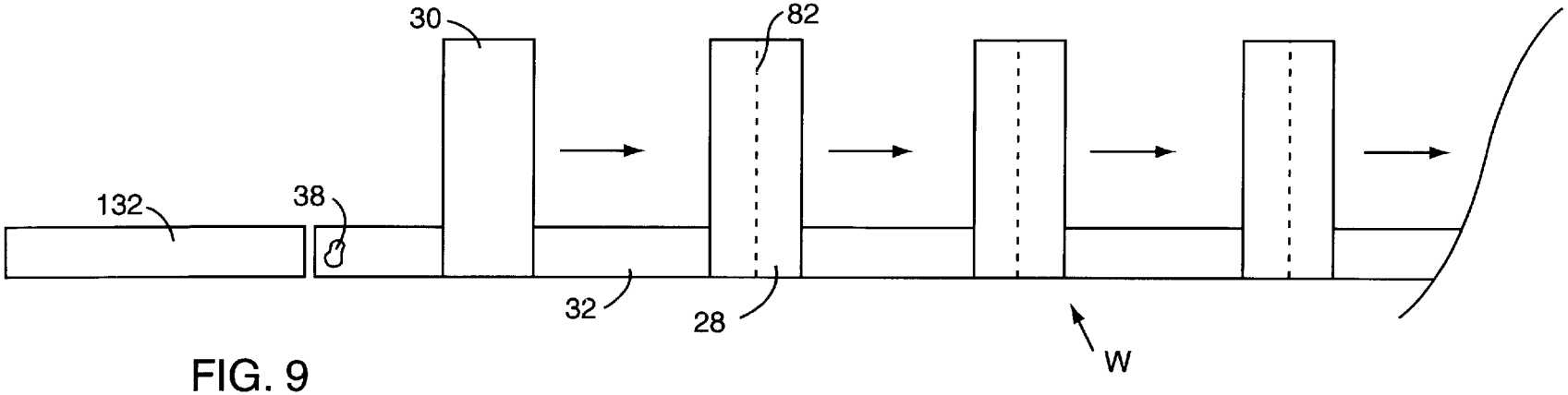
FIG. 9 is a top plan view of a third embodiment of a method of making a container in accordance with the invention.

FIG. 9 shows a continuous method W for making an additional embodiment of the container structures. Supply 132 of rolled sheet materials provides cross-pieces 32 of predetermined dimensions. Adhesive 38 is supplied to the cross-pieces 32 at predetermined locations thereon. Pillars 30 of predetermined dimensions are placed overlaying cross-pieces 32 where adhesive 38 has been placed. Pillars 30 may be scored or perforated 82 and thus will become corner pieces 28 for the framework structure.

Figure 10:
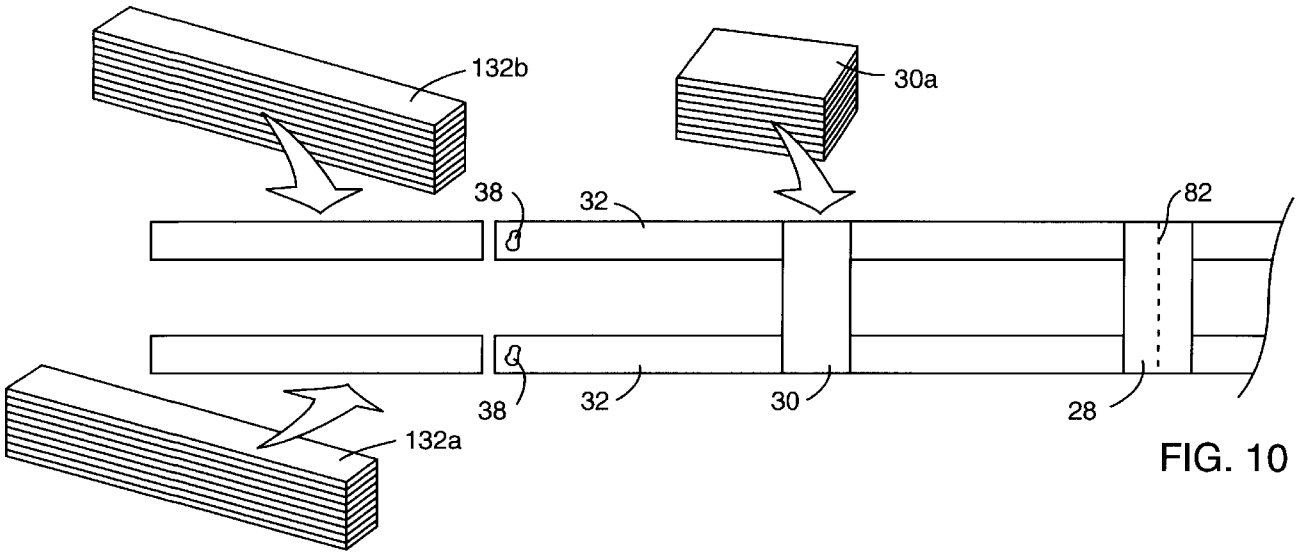
FIG. 10 is a top plan view of a fourth method embodiment.

FIG. 10 shows method X employing a pick-and-place methodology for making a structure for a container such as that shown in embodiment A. Stacked supplies 132*a* and 132*b* of materials provide cross-pieces 32 of predetermined dimensions. Adhesive 38 is supplied to the cross-pieces 32 at predetermined locations thereon. Pillars 30 of predetermined dimensions are picked from a supply 30*a* of pillars and placed overlaying cross-pieces 32 where adhesive 38 has been placed. Pillars 30 may be scored or perforated 82 and thus will become corner pieces 28 for the framework structure.

Figure 11:
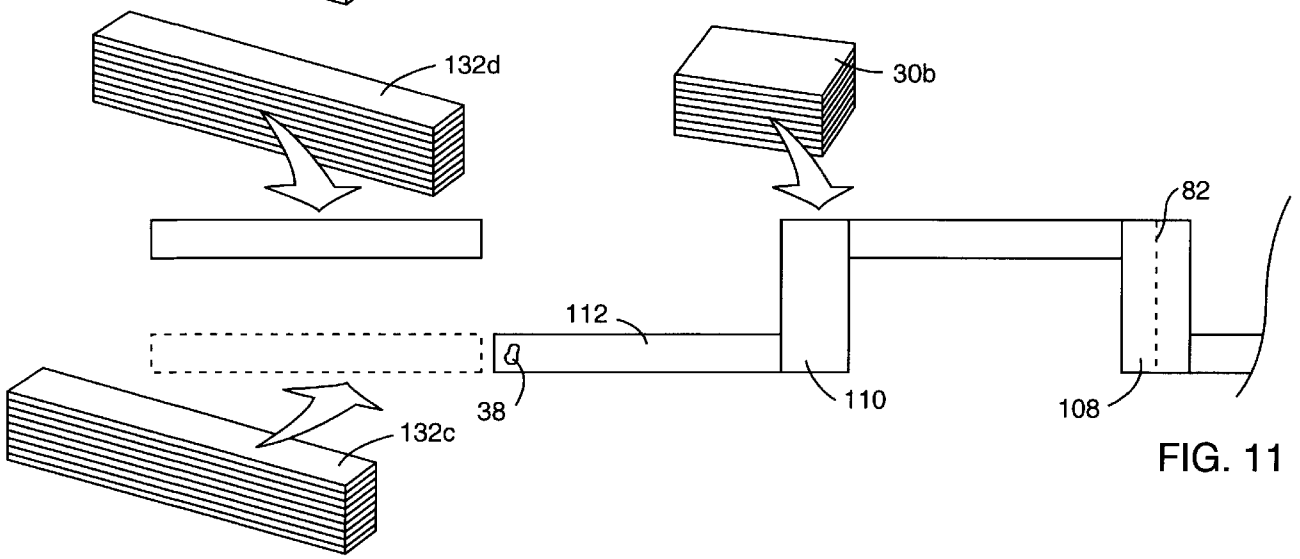
FIG. 11 is a top plan view of a fifth method embodiment of the invention.

FIG. 11 depicts a pick-and-place method Y for making a container structure as used in embodiment C. Supplies 132*c* and 132*d* of materials provide, for example alternatingly, cross-pieces 112 of predetermined dimensions. Adhesive 38 is supplied to the cross-pieces 112 at predetermined locations thereon. Pillars 110 of predetermined dimensions are picked from a supply 30*b* of pillars and placed overlaying cross-pieces 112 where adhesive 38 has been placed. Pillars 110 may be scored or perforated 82 and thus will become corner pieces 108 for the framework structure.

Figure 12:
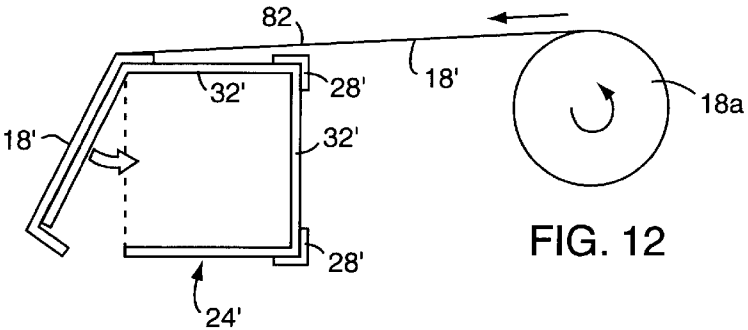
FIG. 12 is a side view of a method of making a container and providing a sheath thereto in accordance with this invention.

FIG. 12 shows a method of making a container of an embodiment of the present invention. Framework structure 24' is folded along lines ofweakness or perforations found in corner pieces 28'. At least one cross-piece 32' is located at each corner. The container so formed may have a plurality of windowed panels forming walls or sides of the container. A sheath 18' of film material similar to that as in FIG. 1 is supplied by a roll 18*a* of sheath material having inner and outer surfaces 20' and 22' is supplied the exoskeleton of the container. The inner surface 20' of sheath 18' is supported by the exterior surface of the exoskeleton of the container.

In view of the foregoing, it will be seen that the several advantages of the invention are achieved and attained.

The embodiments were chosen and described in order to best explain the principles of the invention and its practical application to thereby enable others skilled in the art to beat utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting.

Thus, the breadth and scope of the present invention should not be limited by any of the above-described exemplary embodiments, but should be defined only in accordance with the following claims appended hereto and their equivalents.

What is claimed is:

1. A simplified, skeletonized container for commercial packaging of goods with protection of such goods against the stresses of filling, storage, distribution, merchandising and use of the container, comprising a structural framework providing a rectangular contents-receptive configuration of the container and protecting the container and its contents against such stresses, the framework constituted of framework elements comprising four pillars interconnected by alternating upper and lower bridging cross-pieces to provide an essentially skeletonized structure, said pillars defining four corners of the framework in quadrilateral configuration, each pair of pillars being connected by only one bridging cross-piece to define geometrically a side of the framework, each side of the framework being accordingly a window-defining panel, the framework panels being joined by the corner-defining pillars, which thereby is of four-sided character having first, second, third and fourth sides, a pair of the pillars defining a first side and a pair of the pillars defining a third side, opposite from the first side, being connected only by an upper bridging cross-piece, a pair of pillars defining a second side and pair of pillars defining a fourth side, opposite from the second side, being connected only by a lower bridging cross-piece, such the upper and lower bridging cross-pieces extend between adjacent pairs of pillars in alternating upper and lower relationship, the upper bridging cross-pieces defining an upper periphery of the conatiner and the lower bridging cross-pieces defining a lower peripheral of the container, such that as viewed from one side of the container or from a side opposite therefrom, the framework elements resemble the letter "n" and as viewed from an adjacent side of the container, or from a side opposite therefrom, the framework elements resemble the letter "U", wherein the pillars are each of L-shaped cross section to provide flanges lying in a plane paralleling a respective side and an apex of L-shaped cross section defining a corner edge, the bridging cross-pieces are each of material U-shaped in cross section and receives within its cross section portions of the respective pillars to which each bridging crosspieces is connected, and the framework elements are each of structural material and configuration as will provide the container witrh a strength sufficient to withstand the stresses of fillin, storage, distribution, merchandising and use of the container, the structural material being either recyclable or reusable or both recyclable and reusable to permit subsequent reincorporation by recycling in subsequent generations of containers, the framework adapted for receiving a sheath for conforming to the framework at least over portions thereof, which sheath has selected barrier properties and extending over portions of said container so as to enclose the goods therein in protected relationship.

2. A simplified, skeletonized container for commercial packaging of goods with protection of such goods against the stresses of filling, storage, distribution, merchandising and use of the container, comprising a structural framework providing a rectangular contents-receptive configuration of the container and protecting the container and its contents against such stresses, the framework being constituted of framework elements comprising four pillars and four bridging members, the pillars and bridging members being interconnected in end to end relation in zigzag configuration to provide an skeletonized structure, in which the pillars define four corners of the framework in quadrilateral rectangular configuration, each pair of pillars being bridgedly connected by only one bridging cross-piece to define geometrically a side of the framework, each end of each pillar being connected to a corresponding end of only one corresponding cross-piece such that the interconnected pillars and cross-pieces provide a single continuous closed zigzag peripheral path not branching along the path, each side of the framework being accordingly a window-defining sidewall panel such that the framework is of four-sided character having first, second, third and fourth contiguous sidewall panels each of rectangular geometry, such that a zigzag relationship of pillars and cross-pieces results, wherein the framework is constituted by four rectangular sidewall panels of the framework each bordered by framework members on only three sides of its periphery but having always an unbordered fourth side characterized by an absent bridging cross-piece and the cross-piece absence varies from upper bridging cross-piece to lower bridging cross-piece from one sidewall panel to an adjacent sidewall panel between top and bottom, the framework elements being each of structural material and configuration as will provide the container with a strength sufficient to withstand the stresses of filling, storage, distribution, merchandising and use of the container, the structural material being either recyclable or reusable or both recyclable and reusable to permit subsequent reincorporation by recycling in subsequent generations of containers, the framework adapted for receiving a sheath for conforming to the framework at least over portions thereof, which sheath has selected barrier properties and extending over portions of said container so as to enclose the goods therein in protected relationship wherein the pillars and bridging cross-pieces are each formed of corrugated material having corrugations having a direction which is the same as a direction of elongation of the respective pillar or bridging crosspiece, the pillars being each of L-shaped cross section to provide flanges lying in a plane paralleling a respective side and an apex of the L-shaped cross section defining a corner edge and wherein the bridging cross-pieces are each of material which is U-shaped in cross section and receives within its cross section portions of the respective pillars to which each bridging crosspieces is connected.

3. A simplified, skeletonized container according to claim 2 wherein the bridging cross-pieces are each of double corrugated material.

4. A simplified, skeletonized container according to claim 2 wherein the framework is wrapped with the sheath and the sheath is of paper-based or polymeric material.

5. A simplified, skeletonized container as set forth in claims 2, the pillars and bridging cross-pieces being disposed in mutually perpendicular relation.

6. A simplified, skeletonized container as set forth in claim 2 wherein, as viewed from one side of the container or from a side opposite therefrom, the framework elements resemble the letter "n" and, as viewed from an adjacent side of the container, or from a side opposite therefrom, the framework elements resemble the letter "U".

7. A simplified, skeletonized container as set forth in claim 2, wherein the framework elements are individual elements, and further comprising means bonding the framework elements in joined relation.

8. A simplified, skeletonized container as set forth in claim 2 wherein the framework elements are of paper-based, metal-based or polymeric material.

9. A simplified, skeletonized container according to claim 8 wherein the polymeric material is PVC, PE, PP, PET or PETG.

10. A simplified, skeletonized container according to claim 2 wherein the pillars and bridging cross-pieces are each formed of corrugated material having corrugations having a direction which is the same as a direction of elongation of the respective pillar or bridging cross-piece.

* * * * *

UNITED STATES PATENT AND TRADEMARK OFFICE

CERTIFICATE OF CORRECTION

PATENT NO. : 6,082,571

DATED : July 4, 2000

INVENTOR(S) : Donald J. Avery

It is certified that error appears in the above-identified patent and that said Letters Patent is hereby corrected as shown below:

Column 1, line 58, after "shipped," delete ---- S ----.
Column 11, line 5, "beat" should be ---- best ----.
Column 12, line 1, "wirth" should be ---- with ----.
Column 12, line 2, "fillin" should be ---- filling ----.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*